United States Patent [19]

Koerner et al.

[11] 4,015,263

[45] Mar. 29, 1977

[54] DUAL POLARIZED BLADE ANTENNA

[75] Inventors: John A. Koerner, Belmont; James P. Scherer, Sunnyvale; Donald J. Stoddard, Woodside; George N. Voronoff, San Francisco, all of Calif.

[73] Assignee: Textron, Inc., Belmont, Calif.

[22] Filed: Feb. 23, 1976

[21] Appl. No.: 660,051

[52] U.S. Cl. ..... 343/708; 343/725; 343/770

[51] Int. Cl.[2] ..... H01Q 1/28; H01Q 13/10

[58] Field of Search ..... 343/705, 708, 725, 728, 343/770

[56] References Cited

UNITED STATES PATENTS 3,210,764 10/1965 Anderson et al. ..... 343/708

*Primary Examiner*—Eli Lieberman

*Attorney, Agent, or Firm*—Gregg, Hendricson, Caplan & Becker

[57] ABSTRACT

A very small vertically and horizontally polarized antenna having direction finding capabilities at low microwave frequencies employs filamentary vertically polarized antenna elements and resistively loaded slots for horizontally polarized radiation with a pair of the antennas being employed for direction finding.

6 Claims, 6 Drawing Figures

DUAL POLARIZED BLADE ANTENNA

BACKGROUND OF INVENTION

Directional antennas are known in the art and a variety of different types thereof have been developed; however, such antennas are commonly of a substantial size and/or complexity. An exception to the foregoing is the end loaded filament antenna of U.S. Pat. No. 3,605,097 which may, for example, be employed as a vertically polarized element of the present invention.

Direction finding antennas are commonly comprised as arrays of stub type antennas for vertically polarized signals and rather large spiral antennas for circularly polarized signals. Difficulties are generally encountered in attempts to achieve direction finding capabilities at low microwave frequencies, such as radiation below 2 GHz and stub antennas have very limited bandwidth. In addition many applications of direction finding antennas require the mounting of same upon aircraft so that large size is a serious drawback.

SUMMARY OF INVENTION

The present invention comprises a combination antenna structure having the physical configuration of a blade or the like for ready mounting on aircraft and a single blade in accordance herewith is comprised as a pair of vertically polarized antenna elements within the blade and a pair of vertical resistively loaded slot antennas responsive to horizontally polarized radiation.

A preferred embodiment of the present invention incorporates a pair of end loaded filament antennas of the type described in U.S. Pat. No. 3,605,097, together with a metal element having a pair of slots completely therethrough with resistors end loading the slots and input or output connections across the slots. Physically the antenna may include a dielectric body within which there are disposed the end loaded filament antennas, for example, with a metal foil upon at least a portion of the body and having vertical slots completely through the foil with separate coaxial cables connected across each of the slots. The slots provide horizontally polarized capabilities and the filament antennas provide vertical polarized capability.

Direction finding may be accomplished by employing a pair of blades, as briefly described above, in back-to-back relation and considering the antenna as a radiator, there would thus be formed four beams in both horizontal and vertical polarization. These beams may be formed in a frequency independent manner by utilizing appropriate line lengths and 180° hybrids.

The present invention is also applicable as an omniantenna wherein the horizontally polarized slots are placed in back-to-back relation on a single blade with a dual filamentary vertically polarized antenna mounted between the slots and a base plane to thus provide omni coverage in the azimuth plane.

DESCRIPTION OF FIGURES

The present invention is illustrated as to preferred embodiments thereof in the accompanying drawings wherein.

DESCRIPTION OF PREFERRED EMBODIMENTS

Figure 1:
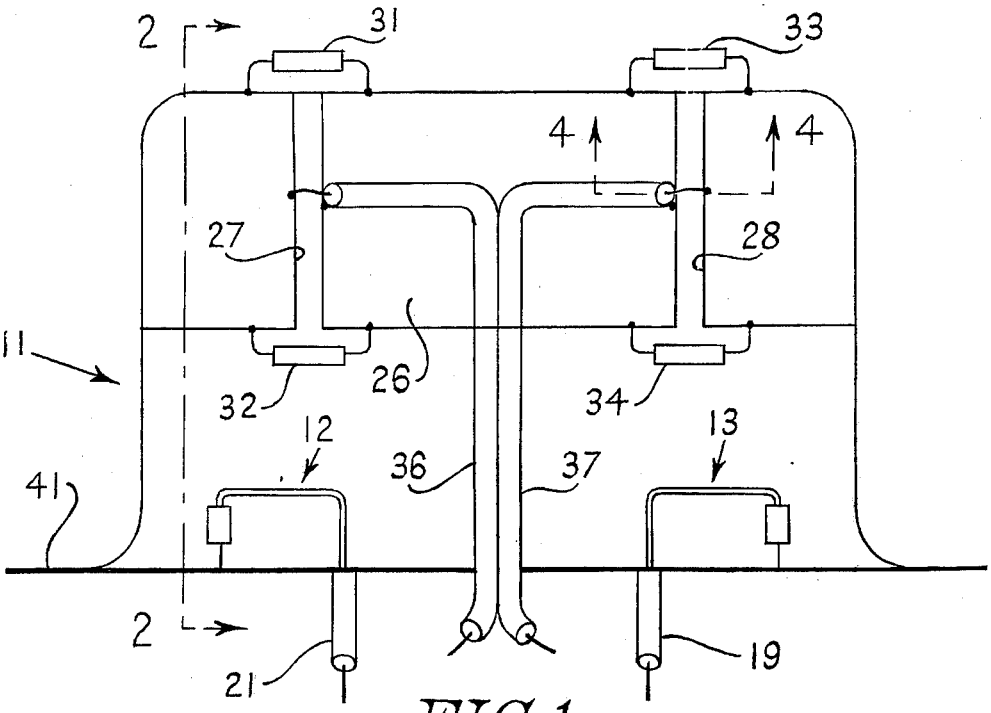
FIG. 1 is a schematic representation of a single blade antenna in accordance with the present invention.
Figure 3:
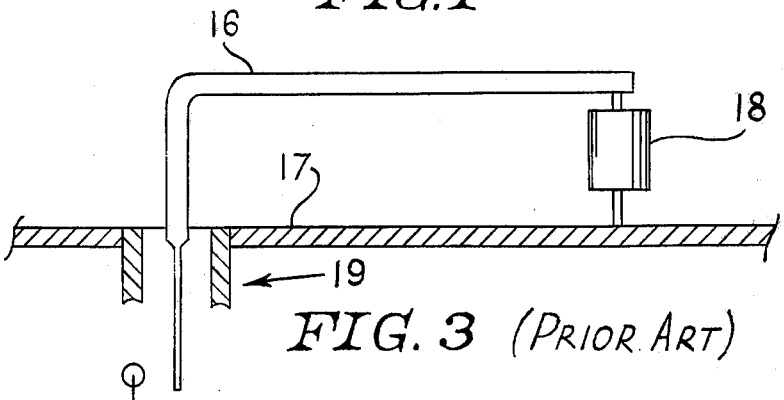
FIG. 3 (PRIOR ART)
FIG. 3 is a schematic illustration of a prior art end loaded filamentary antenna of U.S. Pat. No. 3,605,097.
Figure 2:
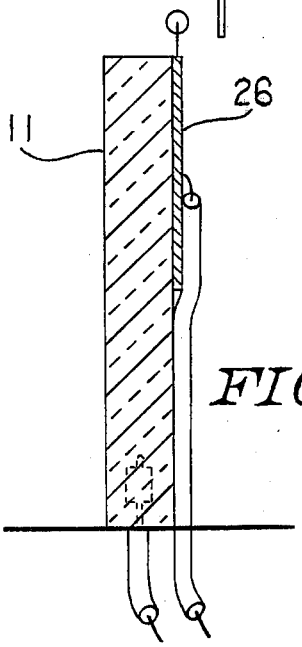
FIG. 2 is a sectional view taken in the plane 2—2 of FIG. 1.

Referring now to FIGS. 1 to 4 of the drawings, it will be seen that a preferred embodiment of the present invention is comprised as a plate-like dielectric body 11 which may, for example, have a generally rectangular configuration as illustrated in FIG. 1 and which may in practice be formed as a pair of contiguous plates. Within the lower portion of this body 11 there are mounted a pair of end loaded filamentary antennas 12 and 13 adapted to receive or radiate vertically polarized radiation. These antennas 12 and 13 may be comprised as described in U.S. Pat. No. 3,605,097 and illustrated in FIG. 3, or they may be formed as shown in copending U.S. patent application Ser. No. 580,950 filed May 27, 1975 for "Electrically Small, Directive, Low Backlobe Antenna" and assigned to the same assignee. Such an antenna may include a filamentary radiator 16 extending upwardly through the ground plane 17 to a termination at the top of a small passive resistor 18 having the bottom end thereof connected to the ground plane. This antenna is energized by a coaxial cable 19 having a central conductor connected to the radiator 16 and an outer sheath connected to the ground plane 17. This type of antenna or a dual end loaded filamentary antenna of this type is only one type of antenna that can be employed for vertical polarization; however, the very small size of this antenna particularly commends it to the present invention. Connections are made by separate coaxial cables 19 and 21 to the vertically polarized antennas 12 and 13 to comprise the vertical inputs or outputs of the antenna.

Figure 4:
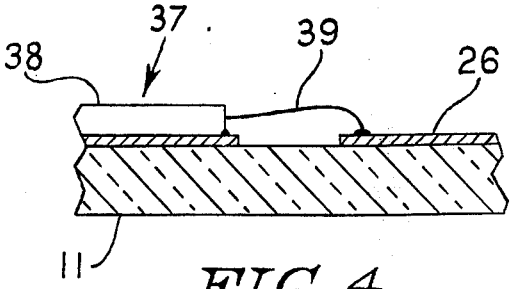
FIG. 4 is a partial sectional view taken in the plane 4—4 of FIG. 1 and illustrating electrical connections of the antenna hereof.

On at least one side of the upper portion of the body 11 there is provided a thin metallic coating such as a metal foil or copper-cladding 26. A pair of vertical slots 27 and 28 are provided completely through the foil 26 in extension from the top to the bottom of the foil, as illustrated in FIG. 1. Each of these slots is resistively loaded at the ends thereof and this is illustrated in FIG. 1 by resistors 31 and 32 connected across the opposite ends of the slot 27 and resistors 33 and 34 connected across the opposite ends of the slot 28. The value of these resistors is chosen to minimize VSWR. Electrical connections to the slot radiators 27 and 28 are provided by a pair of coaxial cables 36 and 37 which may, for example, be mounted against one side of the body 11. The cables 36 and 37 are separately connected across the separate slots 27 and 28 as illustrated in FIG. 4. Thus the sheath 38 of cable 37 is electrically connected to one side of the slot 28 and the central conductor 39 of the cable 37 is extended across the slot and electrically connected to the metal foil 26 on the opposite side of the slot. The cable 36 is similarly connected across the slot 27. Cables 36 and 37 provide horizontal outputs or inputs for the antenna. The antenna may, for example, be mounted upon the skin of an aircraft, as indicated at 41, with the cables 21, 22, 36 and 37 extending therethrough and a cover may be placed over the antenna to protect it from the elements.

Figure 5:
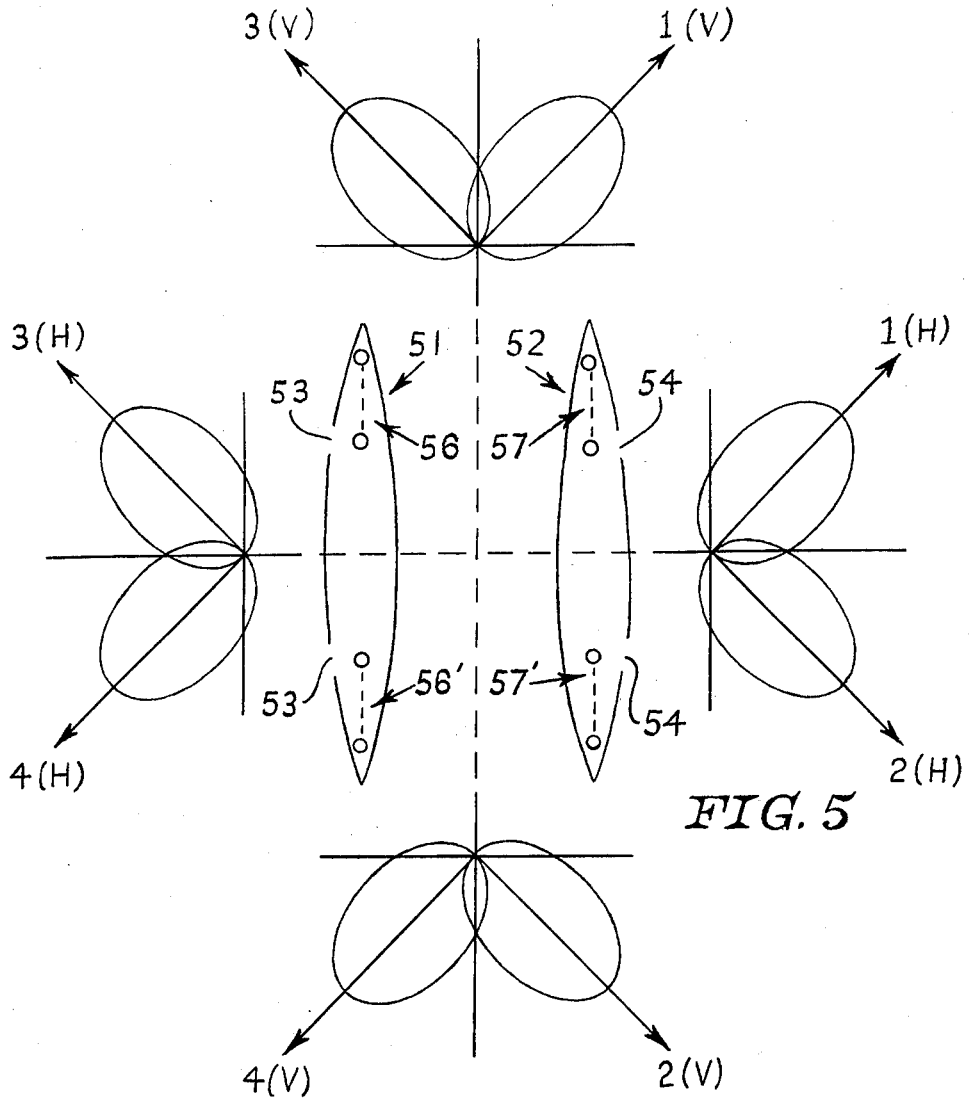
FIG. 5 is an illustration of beam patterns produced by the dual polarized antenna of the present invention.

The present invention may be best employed for direction finding by utilizing a pair of blade antennas, such as the antennas described above and illustrated, for example, in FIG. 1. By disposing these blades in back-to-back relationship, i.e., with the antenna slots facing outwardly, there may be formed four beams in both vertical and horizontal polarization, as illustrated in FIG. 5. These beams are formed in a frequency independent manner using appropriate line lengths or delay lines and magic-tees or 180° hybrids. Referring to FIG. 5, there will be seen to be schematically illustrated a pair of blade antennas 51 and 52 disposed in side-by-side parallel relationship. The antenna 51 has the vertical slots 53 thereof disposed in the side of the antenna away from the other antenna 52 and, similarly, slots 54 on the antenna 52 are disposed on the side thereof opposite from the antenna 51. The vertically polarized antenna elements of antenna 51 are illustrated at 56 — 56' and like elements of antenna 52 are illustrated at 57 — 57'. There are produced by energization of the dual blade antenna of FIG. 5, four beams with each having both vertical and horizontal polarization. These beam patterns are illustrated in FIG. 5 with the beams being numbered 1 to 4 and a notation (V) being employed for a vertically polarized beam and the notation (H) being employed as the notation for horizontally polarized beams. This antenna configuration is particularly advantageous for direction finding.

Figure 6:
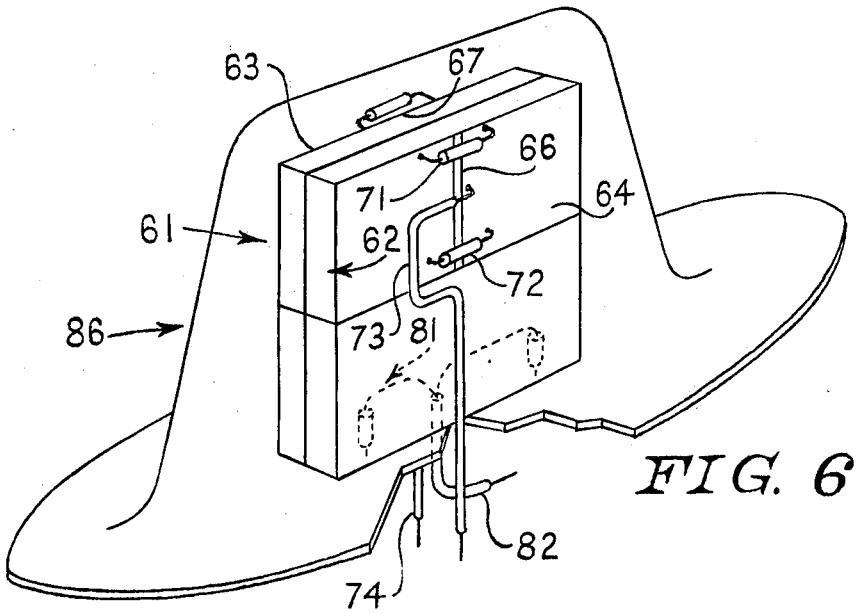
FIG. 6 is a schematic perspective illustration of an omni-antenna in accordance with the present invention.

It is also noted that the present invention may be formed as an omni-antenna. Referring to FIG. 6 there is shown such a configuration including a pair of contiguous dielectric plates 61 and 62 with a metal coating 63 and 64 disposed on the outer faces of the plates 61 and 62, respectively, across the upper portions thereof. A vertical slot 66 extends completely through the metal layer or foil 64 at the center thereof and a similar slot 67 extends through the metal 63 in alignment with the slot 66 on the opposite side of the blade. The slot 66 is terminated at the ends thereof by resistors 71 and 72 connected across the slot and a coaxial line 73 has the sheath thereof connected to one side of the slot 66 and the central conductor extended across into connection with the other side of the slot 66. The other slot 67 is similarly treated with end loading resistors and a coaxial cable 74 connected across the slot. Beneath these slots 66 and 67 there is provided a dual end loaded filament antenna structure 81 within the blade, as by disposition in facing depressions in the dielectric plates 61 and 62. A coaxial cable 82 extends into connection with the end loaded filament antenna 81.

The single blade antenna of FIG. 6 may, for example, be encased in a fin or the like 86 adapted for attachment to the skin of an aircraft and the plates may have a dimension of only four inches square for frequencies as low as 500 MHz, for example. The coaxial cable 82 provides the vertical output and the two coaxial cables 73 and 74 provide the horizontally polarized outputs which may be summed in a magic-T. This particular antenna embodiment has been tested and found to have a VSWR less than 3:1, a ripple of less than 4 decibels, and a gain of -15 decibels to −3 decibels over a 3:1 bandwidth.

The present invention has been described with respect to a preferred embodiment thereof; however, it will be apparent to those skilled in the art modifications and variations may be made within the spirit and scope of this invention and thus it is not intended to limit the invention by the terms of description or details of illustration.

What is claimed is:

1. An improved dual polarized antenna comprising a dielectric blade adapted to extend upwardly from a ground plane, a metal coating upon the upper portion of said blade and having a pair of vertical slots extending completely through said metal to define a pair of slot radiators, a plurality of resistors connected one across each end of each of said slots, electrical connections across each of said slots providing horizontally polarized antenna connections, a pair of vertically polarized antenna elements disposed in said blade between said slots and said ground plane, and electrical connections to said vertically polarized antenna elements providing vertically polarized antenna connections.

2. The antenna of claim 1 further defined by said vertically polarized antenna elements each comprising a radiator extending through said ground plane out of contact therewith and longitudinally of said blade into connection with a resistor connected to said ground plane.

3. The antenna of claim 2 further defined by said electrical connections across said slots each comprising a coaxial cable having the sheath thereof electrically connected to a first slot side and the central conductor thereof extending across the slot into electrical connection with a second slot side, and said electrical connections to said vertically polarized antenna elements each comprising a coaxial cable having a sheath connected to said ground plane and a central conductor connected to said filament through said ground plane.

4. The antenna of claim 1 further defined by said slots being disposed in parallel alignment one on each lateral side of said blade.

5. The antenna of claim 1 further defined by said slots being disposed in spaced parallel relationship on one side of said blade completely separating said metal into separate portions.

6. An improved directional antenna comprising a pair of dielectric blades disposed in side-by-side relation in extension vertically from a ground plane and each of said blades having a metal coating on the upper part of the side thereof away from the other blade, each of said blades having parallel vertical slots through the metal coating thereon with a resistor connected across each end of each slot, electrical connections across each of said slots providing horizontally polarized antenna connections, a pair of vertically polarized antenna elements disposed in each blade between said slots and said ground plane, and electrical connections to each of said antenna elements providing vertically polarized antenna connections.

* * * * *